US010849393B2

(12) United States Patent
Shapiro

(10) Patent No.: US 10,849,393 B2
(45) Date of Patent: Dec. 1, 2020

(54) EARRING BACKING, EARRINGS AND EARRING DISPLAY DEVICES

(71) Applicant: Gabrielle Rae Shapiro, Bryn Mawr, PA (US)

(72) Inventor: Gabrielle Rae Shapiro, Bryn Mawr, PA (US)

( * ) Notice: Subject to any disclaimer, the term of this patent is extended or adjusted under 35 U.S.C. 154(b) by 0 days.

(21) Appl. No.: 16/114,658

(22) Filed: Aug. 28, 2018

(65) Prior Publication Data

US 2019/0059528 A1 Feb. 28, 2019

Related U.S. Application Data

(60) Provisional application No. 62/550,871, filed on Aug. 28, 2017.

(51) Int. Cl.
*A44C 7/00* (2006.01)
*A44C 13/00* (2006.01)

(52) U.S. Cl.
CPC ..... *A44C 7/003* (2013.01); *A44C 13/00* (2013.01); *A44D 2203/00* (2013.01)

(58) Field of Classification Search
CPC . Y10T 24/41; Y10T 24/1959; Y10T 24/1972; Y10T 24/3632; Y10T 24/3696; A44C 13/00; A44D 2203/00
See application file for complete search history.

(56) References Cited

U.S. PATENT DOCUMENTS 2,803,953 A 8/1957 Zubalik
3,034,320 A 5/1962 Feibelman
3,071,939 A 1/1963 Feibelman
3,890,800 A 6/1975 Montague
4,059,971 A 11/1977 Shoji
4,733,544 A * 3/1988 Londaro ..... A44C 7/00 24/705
4,904,031 A 2/1990 Bunten
5,099,659 A 3/1992 Carranza et al.
5,170,542 A * 12/1992 Greenberg ..... A44C 7/003 24/705
5,450,658 A * 9/1995 Hicks ..... A41B 11/002 24/303
7,013,675 B2 * 3/2006 Marquez-Pickering ..... A44C 7/003 63/1.11
7,895,774 B2 * 3/2011 Pawsey ..... A43B 1/0054 36/112

(Continued)

*Primary Examiner* — Jack W Lavinder

(74) *Attorney, Agent, or Firm* — Buchanan Ingersoll & Rooney PC

(57) ABSTRACT

A connectable earring back element, comprising: a retainer element, said retainer element having a through hole the diameter of which is sized to receive an earring post; and a body, said body having means for connecting one connectable earring back element to another connectable earring back element. In one embodiment, each connecting earring back element includes a magnet or the body is made of a magnetic material such that the connectable earring back elements may be connected through magnetic forces. In some instances, a display panel may be included in an earring set to display the earrings, where the display panel may be decorative and may include magnets or be made of a magnetic material for affixing of the connecting earring back elements thereto.

18 Claims, 6 Drawing Sheets

(56) References Cited

U.S. PATENT DOCUMENTS

| | | | | |
|---|---|---|---|---|
| 8,151,980 | B2 * | 4/2012 | DeMartino | A47G 29/08 206/495 |
| 9,159,251 | B2 * | 10/2015 | Berry | A41F 1/002 |
| 2005/0120743 | A1 | 6/2005 | Pickering | |
| 2007/0124898 | A1 * | 6/2007 | Clark | A44C 17/0216 24/303 |
| 2008/0271296 | A1 * | 11/2008 | Jepsen | A44C 5/2076 24/265 EC |
| 2009/0194650 | A1 | 8/2009 | Corvo et al. | |
| 2011/0191991 | A1 * | 8/2011 | Meneau | A44C 7/003 24/705 |
| 2014/0263116 | A1 | 9/2014 | Wojciechowski | |
| 2015/0135495 | A1 * | 5/2015 | Levinson | A44C 7/003 24/705 |
| 2016/0120273 | A1 | 5/2016 | Lee et al. | |
| 2016/0374438 | A1 * | 12/2016 | Fujita | A44B 17/0005 24/303 |

* cited by examiner

Pentagonal prism

Cones

Flowers

Tetrahedron

Spikes

"Nuts"

"Butterfly" (AKA friction)

"Discs" (nut & plastic)

"Screw backs" (spun on a post)

"La Pousette" (very thin)

"Jumbo"

"Dome/Button"

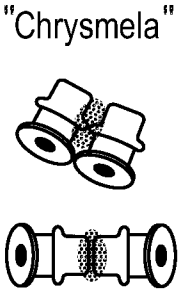
FIG. 2U
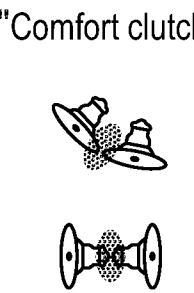
FIG. 2V
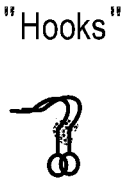
FIG. 2W
FIG. 2Y
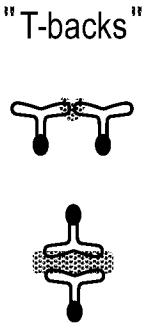
FIG. 2X

EARRING BACKING, EARRINGS AND EARRING DISPLAY DEVICES

FIELD

A mutually magnetically or mechanically connectable earring back elements for post style earrings, earrings, and displays for earrings.

BACKGROUND

Earrings for pierced ears are often convenient and fashionable in that the mechanism for securing the earring to the ear is a simple post that projects through an aperture formed in the earlobe or other suitable body part and is secured by a backing element. The backing element creates a frictional or other mechanical (e.g., screw threading, ratchet, friction fit, clamped, etc.) fit with the post to secure the earring.

But for simple earrings or earrings that are small, it is often easy to lose one or both of the earrings. When the user is hurried or inattentive, he or she may haphazardly place the earrings on a flat or tilted surface or in a bag or purse. Most earrings don't balance on surfaces and can roll off. This can be devastating if they slip down a sink drain or fall behind a cabinet. Further, if one takes them off and puts them into a bag or purse, they can separate and be more difficult to locate. Of course, the exterior part of the earring is the aesthetic part and modifying it to solve this problem is not a particularly viable solution. In fact, the inventor conducted a survey of fifty (50) participants, both male and female, that revealed earrings make it into the top five list of the things people lose the most often.

Various solutions have been attempted, such as an earring connector, which is a short chain having grommets on either end through which the post of the earring is projected and the earring back connected so as to trap the two earrings together by the chain. But this is inconvenient and there is nothing retaining the chain, which simply becomes a third element that can be lost. What is needed is a way to reduce the chances of losing individual earrings without destroying the aesthetic nature of the earring itself. Further, classic earring backs are often easy to lose, usually have odd shapes and blend into most surfaces. They are typically metal which makes them slippery and they are individual, separate pieces.

SUMMARY OF THE INVENTION

The present inventor has discovered that when earrings are connected, they are less prone to be lost. To facilitate this, the present inventor has devised a cleaver mechanism that does not necessarily require dexterity or complex manual manipulation, can be done quickly and intuitively and done without affecting the aesthetic nature of the ornamental part of the earring, depending on implementation. These features and advantages are not required to be present in every embodiment, but depending on implementation one or more and even all of the advantages may be obtained.

BRIEF DESCRIPTION OF THE DRAWING FIGURES

The scope of the present disclosure is best understood from the following detailed description of exemplary embodiments to which the invention is not limited when read in conjunction with the accompanying drawings. Included in the drawings are the following figures.

Further areas of applicability of the present disclosure will become apparent from the detailed description provided hereinafter. It should be understood that the detailed description of exemplary embodiments are intended for illustration purposes only and are, therefore, not intended to necessarily limit the scope of the disclosure.

DETAILED DESCRIPTION

Figure 1A:
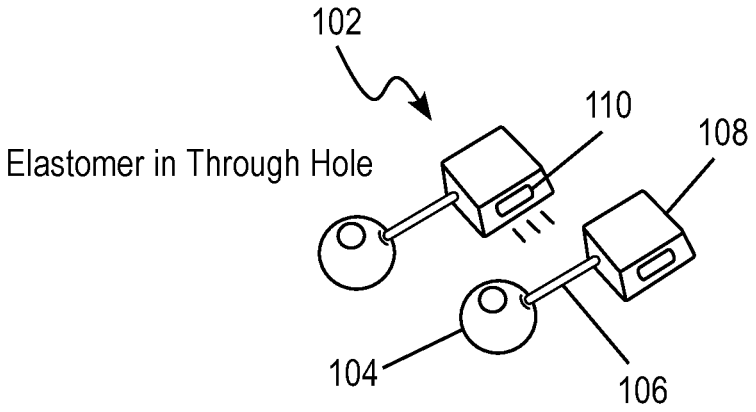
FIGS. 1A and 1B are diagrams illustrating earrings including a connectable earring back element comprised of an exemplary cubic body configured to magnetically connect one connectable earring back element to another, in accordance with exemplary embodiments.

FIG. 1A illustrates a pair of earrings 102 having connectable earring back elements that are configured to be connected to one another, which may assist individuals in keeping track of their earrings 102, reducing the likelihood of separation of the earrings 102 comprising the pair, make it easier to display the earrings 102, and increase visibility of the earrings 102 in situations where traditional earrings may be lost or overlooked.

The earrings 102 are known to persons having skill in the art as post earrings. Post earrings 102 are comprised of a decorative element 104, a post 106, and an earring back element 108, which, in the methods discussed herein, may also be referred to as a connectable earring back element 108. It will be apparent to persons having skill in the relevant art that the connectable earring back elements 108 discussed herein may be used in any type of earring, and are not limited to post earrings or other earrings of similar configuration.

As illustrated in FIG. 1A, the connectable earring back element 108 of each earring 102 may include a through hole, in which the post 106 is received. In some embodiments, the through hole may be included in a retainer element, which may be a separate element from a body of the connectable earring back element 108. In some cases, the through hole may include an elastomer, such as a silicone rubber, or other material that may be configured to frictionally engage the post 106. In other cases, an adhesive or other such material may be received in the through hole prior to receipt of the post 106, to affix the post 106 thereto. In some instances, the through hole may include a butterfly clamp, a spring based clutch, or other such mechanism for engaging the post 106.

In some embodiments, silicone rubber, or other material that possibly has a higher frictional coefficient than metal or the like, may coat the connectable earring back element 108, particularly with respect to embodiments such as shown in FIGS. 2N-2X, described below, for instance. In still other embodiments, the body of the connectable earring back element 108 is largely made of silicone rubber, or other non-magnetic material, with a through hole extending through this material and with a magnet as a connecting means 110 (described below) embedded therein. The magnet might possibly be to one side of an centralized through-hole so that the connectable earring back elements 108 have a preference as to how they are magnetically pair together, and possibly with a metal plate or disc positioned between the embedded magnet and an outer plane of the connectable earring back element 108 that would act to direct the magnetic flux lines to the preferred side on which two connectable earring back elements 108 would connect.

It should also be noted that the connectable earring back elements 108 can be colored in any color or colors or patterns of colors. They can be opaque. They can also be translucent, semitransparent, or transparent (whether clear or colored). This may assist in sorting of earrings by type, value, formality, coordination with other accessories or clothes, by appropriateness for a type of event, or any other criteria, or can be for aesthetics or coordination with the earrings 102. Indicia can be included for these or other purposes as well.

Figure 1B:
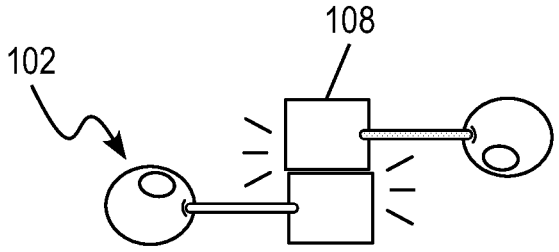

Each of the connectable earring back elements 108 of the earrings 102 may include a connecting means 110 for connecting one connectable earring back element 108 to another connectable earring back element 108. The connecting means 110 may be such that the connectable earring back elements 108 of each of the earrings 102 may be connected and, in some cases, may remain connected unless physically separated by an individual. As illustrated in FIG. 1B, the earrings 102 may be situated such that the connecting means 110 of each of the connectable earring back elements 108 are aligned, whereby the connectable earring back elements 108 may be connected, thus connecting the earrings 102 to one another. In an exemplary embodiment, the connecting means 110 may be a magnet, primarily a permanent magnet, though an electromagnet could be used. The earring back elements 108 can include a separate magnet or be made up of magnetic materials. Exemplary magnetic materials include ceramics (e.g., ferrite), alnico, samarium cobalt (a rare earth magnet) and neodymium iron boron.

In some instances, the body of the connectable earring back element 108 may be made of a magnetic material, such that the entirety of the connectable earring back element 108 or a substantial amount of the connectable earring back element 108 (e.g., minus the retainer element and/or through hole) is made of the magnetic material. In such instances, the connectable earring back element 108 as a whole may be considered the connecting means 110, or a magnet can be added or embedded into the earring back element 108, where the connectable earring back elements 108 of the earrings 102 may be connected without any particular alignment, such as by close enough proximity to enable the magnetic forces to work. The magnetic poles can be aligned to facilitate the earrings connecting together in a particular pattern by the attraction of opposite poles oriented appropriately, preferably for display, to protect the esthetic elements of the earrings by preventing them from rubbing together, or for other reasons.

In other embodiments, the connecting means 110 may be comprised of or may otherwise include an entanglement connector 112, such as shown in FIG. 2Y (illustrating a single connector or a plurality of such connectors). An entanglement connector 112 may be a type of connector that uses physical orientation or forces to achieve a connection and maintain the connection until physical force or another mechanism is used to break the connection. For instance, an entanglement connector may be comprised of an enlarged distal 112A end and a recess 112B having an enlarged interior portion, wherein an enlarged distal end of one connectable earring back element 108 is sized to fit the enlarged interior portion of the other connectable earring back element 108. In some cases, an entanglement connector 112 may be made of an elastomeric material, which may result in entanglement when physically interacted with another connectable earring back element 108. In another example, an entanglement connector may utilize a slide and locking mechanism, whereby a projection of one connectable earring back element 108 may slidingly engage a recess of another connectable earring back element 108 to lock the two connectable earring back elements 108 together.

The body of the connectable earring back element 108 may have any of a plurality of three dimensional shapes. Any three dimensional shape that is able to house or otherwise utilize the connecting means 110 may be suitable for use of the body of a connectable earring back element 108. Most earrings have posts, and each body of the connectable earring back element 108 may be of a shape that is able to include a through hole for receipt of the post 106 of the earring 102. In some embodiments, the body of each connectable earring back element 108 may include at least one flat surface that is non-orthogonal to the axis of said through hole, and by extension the post 106 of the earring 102. In such embodiments, the flat surface may be used to prevent movement of the earring 102 when placed on a surface.

Figure 2A:
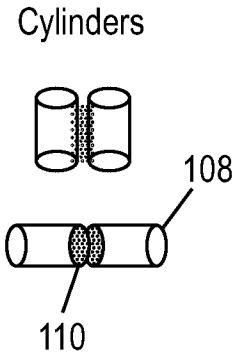
FIGS. 2A through 2Y are diagrams illustrating connectable earring back elements of different shapes and positioning of connectable elements thereof of the earrings of FIGS. 1A and 1B, in accordance with exemplary embodiments.
Figure 2B:
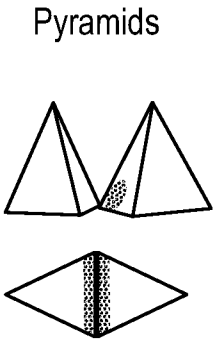
Figure 2C:
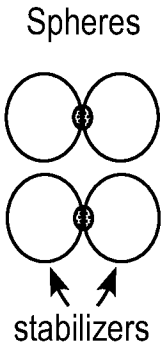
Figure 2D:
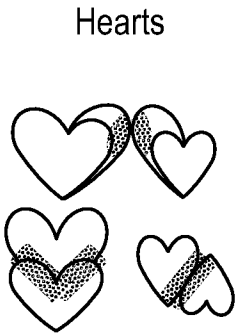
Figure 2E:
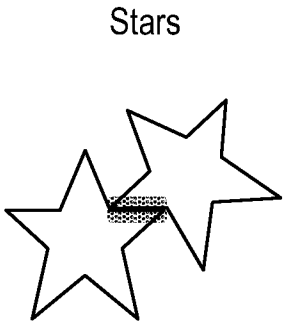
Figure 2F:
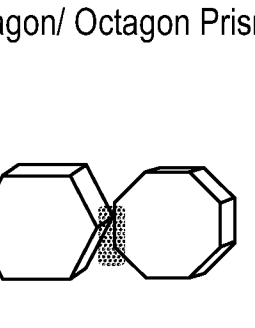
Figure 2G:
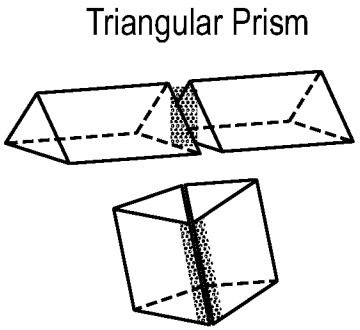
Figure 2H:
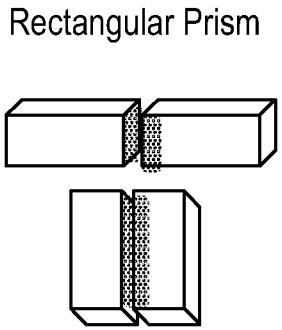
Figure 2I:
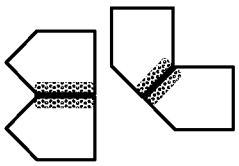
Figure 2J:
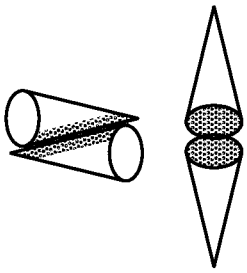
Figure 2K:
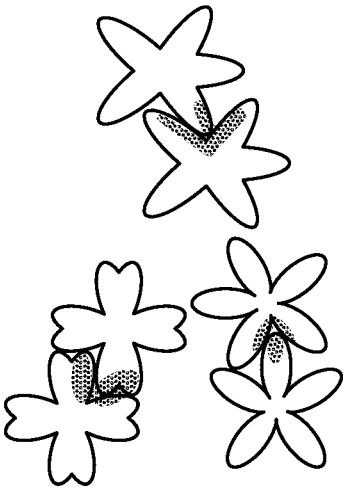
Figure 2L:
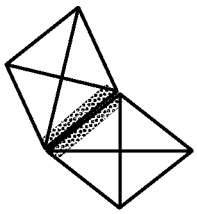
Figure 2M:
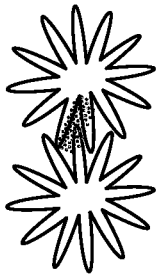
Figure 2N:
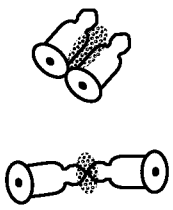
Figure 2O:
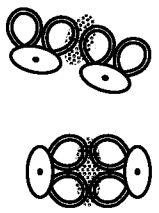
Figure 2P:
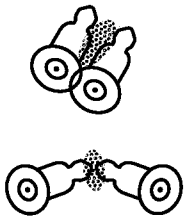
Figure 2Q:
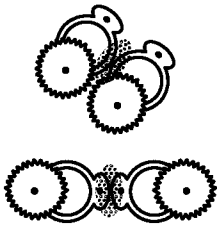
Figure 2R:
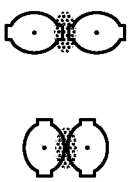
Figure 2S:
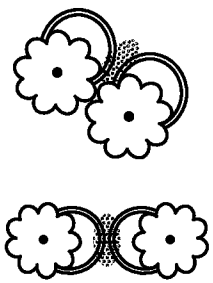
Figure 2T:
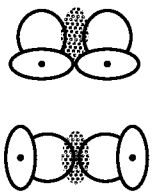

FIGS. 2A through 2X illustrate example bodies of connectable earring back elements 108 for use as discussed herein. Each of the bodies may be of a different three-dimensional shape and include a flat surface that may be situated non-orthogonal to an axis of a through hole, such that the connectable earring back element 108 comprising the body may be used as part of a post earring. As illustrated in FIGS. 2A through 2X, each connectable earring back element 108 may also include a connecting means 110 situated therein for connecting the connectable earring back element 108 to another connectable earring back element 108. These shapes, by way of a non-exhaustive list, include: cylinders (FIG. 2A), pyramids (FIG. 2B), spheres (FIG. 2C), hearts (FIG. 2D), stars (FIG. 2E), hexagon/octagon prism (FIG. 2F), triangular prism (FIG. 2G), rectangular prism (FIG. 2H), pentagonal prism (FIG. 2I), cones, with optional flattened side (FIG. 2J), flowers (FIG. 2K), tetrahedron (FIG. 2L), spikes (FIG. 2M), nuts (FIG. 2N), butterfly (aka friction) (FIG. 2O), discs (nut and plastic) (FIG. 2P), screw backs (spun on a post) (FIG. 2Q), La Pousette (very thin) (FIG. 2R), jumbo (FIG. 2S), dome/button (FIG. 2T), Chrysmela (FIG. 2U), comfort clutch (FIG. 2V), hooks (FIG. 2W), T-backs (FIG. 2X) and entanglement connecting backs (FIG. 2Y), for example. In short, the earring back elements 108 can be shaped as any of a cube, a cuboid, a sphere with an optionally omitted segment, an ellipsoid with an optionally omitted segment, a cone with an optionally flattened side surface, a frustro-conic cone with an optionally flattened side surface, a triangular prism, a hexagonal prism, a triangular based pyramid, a square based pyramid, a hexagonal based pyramid, a tetrahedron, an octahedron, a dodecahedron, an icosahedron, and an asymmetrically shaped three dimensional shape, or any combinations of these shapes.

In some cases, the connecting means 110 may be situated in more than one possible position in a connectable earring back element 108, and may be illustrated. However, it is noted that the examples illustrated in FIGS. 2A through 2X are illustrations only, and that additional configurations (e.g., locations of flat surfaces and/or connecting means 110) of illustrated three dimensional shapes may be used, and additional three dimensional shapes may be used as connectable earring back elements 108 in accordance with the present disclosure.

In the illustrated examples, each connectable earring back element 108 may include a connecting means 110, illustrated by the shaded area. In the illustrated examples, two connectable earring back elements 108 (e.g., for a pair of earrings 102) are connected by the connecting means 110, which may be, as discussed above, a magnet, entanglement connector, or other suitable means. For instance, in FIG. 2A the body of the connectable earring back element 108 is in the shape of a cylinder, where the connecting means 110 may be situated in either the rounded side, or the flat side, as illustrated. In another example, in FIG. 2E, the body of the connectable earring back element 108 may be in the shape of a star, where the connecting means 110 may be situated in any of the edges of the star, such that the connectable earring back elements 108 of a pair of earrings 102 may be connected as illustrated. In some cases, a connectable earring back element 108 may include multiple connecting means 110. For instance, the stars in FIG. 2E may include a connection means 110 in each of the arms of the star such that the two connectable earring back elements 108 may be connected in any configuration. Similarly, if the body of each connectable earring back element 108 is comprised of a magnetic material, the connectable earring back elements 108 may be connected in any configuration and orientation.

In some embodiments, the connectable earring back element 108 of each earring 102 may be weighted. In such embodiments, the weight of the connectable earring back element 108 may be of at least an amount to prevent bouncing of the earring 102 when dropped on a flat surface or to otherwise ensure that the earring 102 does not move a significant distance, to prevent loss thereof. In some cases, the connectable earring back element 108 may also be painted or otherwise of a color to increase visibility of the connectable earring back element 108 and the earring 102 as a whole, to also prevent loss. In such instances, these properties, in addition to the ability to connect two connectable earring back elements 108 together may reduce the likelihood of losing one or both earrings 102 of a pair and may make increase the success of finding earrings 102 in instances of loss.

Figure 3:
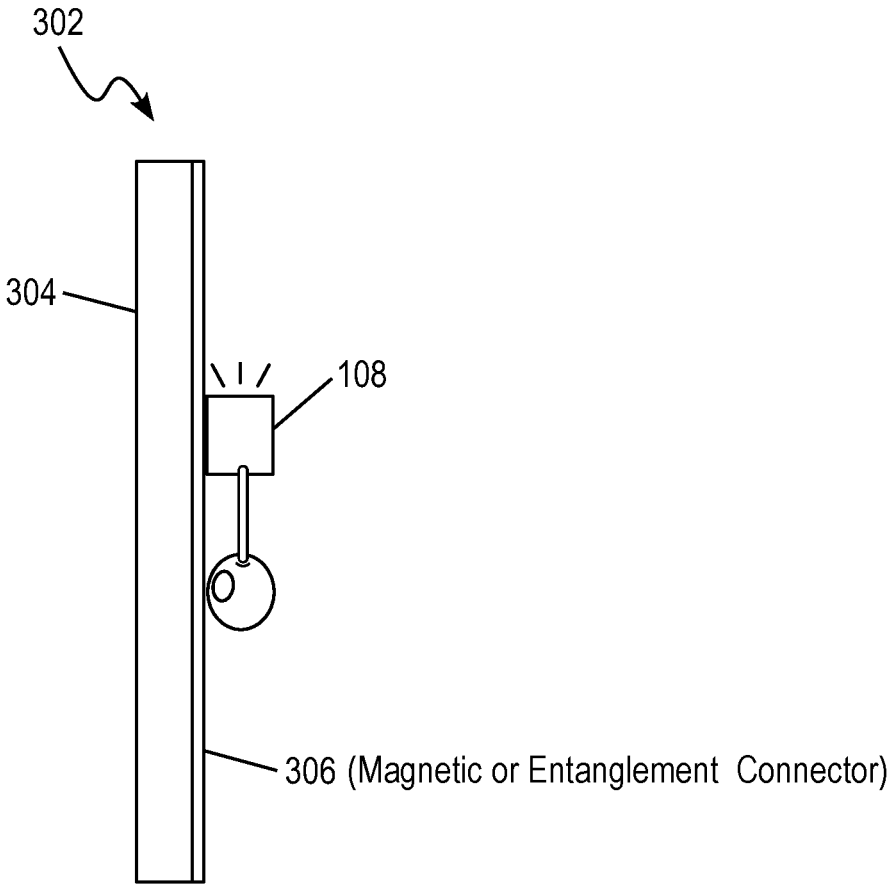
FIG. 3 is a diagram illustrating a magnetic plate display panel used for keeping the magnetically connected cubic earring backs in place in accordance with exemplary embodiments.

In some cases, the connectability of the connectable earring back element 108 of one or more earrings 102 may also be used in the display thereof. FIG. 3 illustrates the display of an earring 102 on a magnetic plate display panel 302. In some embodiments, the display panel 302 may include a base layer 304 that is made of a magnetic or ferritic material or is otherwise configured to connect to a connectable earring back element 108 via the connecting means 110 thereof. For instance, if the connecting means 110 is a magnet, the display panel 302 may include a magnetic base layer 304 where an earring 102 may be affixed thereto via connection of the magnet in the connectable earring back element 108 to the display panel 302. In another example, if the connecting means 110 is an entanglement connector, the display panel 302 may include a base layer 304 that includes one or more entanglement connectors configured to engage with the entanglement connector of the connectable earring back element 108 of an earring 102. For instance, the base layer 304 may be made of an elastomeric material, and/or the base layer 304 may include a plurality of recesses in which connecting means 110 of connectable earring back elements 108 may be inserted. In some cases, a display panel 302 may also include a decorative outer layer 306 or other elements to enhance the display, and, in some cases, may be used to obscure the connection mechanism(s) of the display panel 302. For example, a decorative outer layer 306 may be used to cover the base layer 304 of magnetic material such that connectable earring back elements 108 may be affixed to the display panel 302 through the decorative layer 306. The decorative outer layer 306 can be a mirror surface, a surface having a decorative pattern or outlines of earring types or other organizational indicia, logos, sayings, and/or a texture. The display panel 302 may be a plate designed to lie flat on a surface, may be of any geometric shape (e.g., a round, polygonal or irregular shape perhaps representing something of interest (animal, logo, etc.) having a flat, concave or convex surface, a tree of ferromagnetic wires or shaped material, etc. The display panel 302 can be part of something larger, such as a jewelry box (table top or for keeping in a purse), door, plaque, or wall hanging, to name a few.

The use of such a display panel 302 may further reduce the loss of earrings 102 while also increasing the efficiency of the display of earrings 102. For instance, traditional displays often require specific orientations of each earring 102 on the display and in specific locations, which may be a time consuming process. In embodiments where the body of the connectable earring back element 108 and the display panel 302 are magnetic materials, an individual could very quickly and easily affix an earring pair 102 thereto via the magnetic forces. For instance, an individual could quite literally toss their earrings 102 at a display panel 302, where the magnetic forces would ensure that the connectable earring back elements 108 connect to the display panel 302 when in physical proximity. In such an instance, a person's earrings 102 may be stored safely for retrieval in a single, fast, and easy to execute motion.

Accordingly, the earrings 102 and connectable earring back elements 108 discussed herein may result in easier storage of earrings 102, easier retrieval of earrings 102, less instances of loss of earrings 102, faster recovery of earrings 102, and easier maintaining of sets of pairs of earrings 102 than using traditional methods and systems.

Techniques consistent with the present disclosure provide, among other features, earrings, earring backings, earring sets, and earring display devices. While various exemplary embodiments of the disclosed system and method have been described above it should be understood that they have been presented for purposes of example only, not limitations. It is not exhaustive and does not limit the disclosure to the precise form disclosed. Modifications and variations are possible in light of the above teachings or may be acquired from practicing of the disclosure, without departing from the breadth or scope.

What is claimed is:

1. A connectable earring back element, comprising:

a retainer element, said retainer element having a through-hole with a diameter sized to receive an earring post; and a body, said body having means for connecting the connectable earring back element to a second connectable earring back element at surfaces of the connectable earring back element and the second connectable earring back element that are not intended to be in contact with a surface of an ear when worn, wherein said means for connecting comprises a magnetic material embedded in the body.

2. The connectable earring back element of claim 1, wherein the retainer element includes an elastomer in said through-hole to frictionally engage an earring post.

3. The connectable earring back element of claim 2, wherein the elastomer includes a silicone rubber.

4. The connectable earing back element of claim 3, wherein said body has a shape of a cube and is coated with silicone rubber.

5. The connectable earring back element of claim 1, wherein the retainer element includes a butterfly clamp.

6. The connectable earring back element of claim 1, wherein the retainer element includes a spring based clutch.

7. The connectable earring back element of claim 1, wherein the retainer element includes screw threading.

8. The connectable earring back element of claim 1, wherein said means for connecting includes a magnet.

9. A pair of connectable earring back elements in accordance with claim 1.

10. An earring set comprising:

at least one pair of connectable earring back elements in accordance with claim 1; and a display panel.

11. The earring set of claim 10, wherein said display panel includes a base layer made to include at least one of: a magnetic material and a ferritic material.

12. The earring set of claim 11, wherein said display panel further includes a decorative outer layer covering at least one side of the base layer.

13. The connectable earring back element of claim 1, wherein said body has at least one flat surface that is non-orthogonal to an axis of said through hole.

14. The connectable earring back element of claim 1, wherein said body has a three dimensional shape selected from a group consisting of: a cube, a cuboid, a sphere with an omitted segment, an ellipsoid with an omitted segment, a cone with a flattened side surface, a frustro-conic cone with a flattened side surface, a triangular prism, a hexagonal prism, a triangular based pyramid, a square based pyramid, a hexagonal based pyramid, a tetrahedron, an octahedron, a dodecahedron, an icosahedron, and an asymmetrically shaped three dimensional shape.

15. A connectable earring back element, comprising:

a retainer element, said retainer element having a through-hole with a diameter sized to receive an earring post; and a body, said body having means for connecting the connectable earring back element to a second connectable earring back element at surfaces of the connectable earring back element and the second connectable earring back element that are not intended to be in contact with a surface of an ear when worn, wherein said body has at least one flat surface that is non-orthogonal to an axis of said through hole and said body comprises a magnetic material embedded in the body.

16. A connectable earring back element, comprising:

a retainer element, said retainer element having a through-hole with a diameter sized to receive an earring post; and a body, said body having means for connecting the connectable earring back element to a second connectable earring back element at surfaces of the connectable earring back element and the second connectable earring back element that are not intended to be in contact with a surface of an ear when worn, wherein said body has a three dimensional shape selected from a group consisting of: a cube, a cuboid, a sphere with an omitted segment, an ellipsoid with an omitted segment, a cone with a flattened side surface, a frustro-conic cone with a flattened side surface, a triangular prism, a hexagonal prism, a triangular based pyramid, a square based pyramid, a hexagonal based pyramid, a tetrahedron, an octahedron, a dodecahedron, an icosahedron, and an asymmetrically shaped three dimensional shape;

and wherein said body comprises a magnetic material embedded in the body.

17. A pair of connectable earing back elements, comprising a pair of cube shaped earring back elements each made of silicone rubber with a magnet embedded therein, and each having a through-hole sized to frictionally engage an earring post.

18. A pair of connectable earing back elements, comprising a pair of three dimensional shaped earring back elements each made of silicone rubber with a magnet embedded therein, and each having a through-hole sized to frictionally engage an earring post, wherein said body has a three dimensional shape selected from a group consisting of: a cuboid, a sphere with an omitted segment, an ellipsoid with an omitted segment, a cone with a flattened side surface, a frustro-conic cone with a flattened side surface, a triangular prism, a hexagonal prism, a triangular based pyramid, a square based pyramid, a hexagonal based pyramid, a tetrahedron, an octahedron, a dodecahedron, an icosahedron, and an asymmetrically shaped three dimensional shape.

* * * * *